US009010825B2

(12) United States Patent
Shepherd et al.

(10) Patent No.: US 9,010,825 B2
(45) Date of Patent: Apr. 21, 2015

(54) CLOSURE APPARATUS AND METHOD OF USING SAME

(71) Applicant: Bag-Straps, Inc., Charlotte, NC (US)

(72) Inventors: Jason W. Shepherd, Charlotte, NC (US); Heyward A. Moore, Charlotte, NC (US); Juan Carlos Perez, Charlotte, NC (US)

(73) Assignee: Bag-Straps, Inc., Charlotte, NC (US)

( * ) Notice: Subject to any disclaimer, the term of this patent is extended or adjusted under 35 U.S.C. 154(b) by 0 days.

(21) Appl. No.: 14/208,192

(22) Filed: Mar. 13, 2014

(65) Prior Publication Data

US 2014/0265397 A1 Sep. 18, 2014

Related U.S. Application Data

(60) Provisional application No. 61/790,335, filed on Mar. 15, 2013.

(51) Int. Cl.

| | |
|---|---|
| ***A45F 5/00*** | (2006.01) |
| ***B65D 63/18*** | (2006.01) |
| ***B65D 33/06*** | (2006.01) |

(52) U.S. Cl.

CPC ..... *B65D 63/18* (2013.01); *B65D 33/06* (2013.01)

(58) Field of Classification Search

CPC ..... B65G 7/12; A45F 5/10; A45F 5/00; A45F 2005/1013; B65D 33/06; B65D 63/18

USPC ..... 294/150, 151, 153, 156, 165

See application file for complete search history.

(56) References Cited

U.S. PATENT DOCUMENTS

| | | | | | |
|---|---|---|---|---|---|
| 221,616 | A | * | 11/1879 | Rubin | 294/150 |
| 417,942 | A | * | 12/1889 | Raffel | 294/146 |
| 3,191,830 | A | * | 6/1965 | Goetz | 294/156 |
| 4,043,493 | A | * | 8/1977 | Camelio | 294/165 |
| 4,796,936 | A | * | 1/1989 | Sherin | 294/31.2 |
| 4,828,310 | A | * | 5/1989 | Schmidt et al. | 294/153 |
| 4,832,393 | A | * | 5/1989 | Pitchford | 294/156 |
| 5,042,114 | A | * | 8/1991 | Parrish | 24/16 PB |
| 5,348,362 | A | * | 9/1994 | Rolls | 294/151 |
| 6,601,890 | B1 | * | 8/2003 | Firth | 294/74 |
| 7,455,339 | B2 | * | 11/2008 | Staples | 294/156 |
| 2014/0084614 | A1 | * | 3/2014 | Ganaza | 294/150 |

FOREIGN PATENT DOCUMENTS

| | | | | |
|---|---|---|---|---|
| EP | 1013194 | A1 | 6/2000 | |
| FR | 2632933 | A1 * | 12/1989 | B65D 63/18 |

* cited by examiner

*Primary Examiner* — Saul Rodriguez
*Assistant Examiner* — Gabriela Puig
(74) *Attorney, Agent, or Firm* — Ashley Law Firm P.C.; Stephen S. Ashley, Jr.

(57) ABSTRACT

An apparatus for closing opened packaging includes a base having an upper surface and a lower surface, a strap attached to the base, and two complementary handle sections attached to the base. The handle sections extend upwardly from the upper surface of the base, and together form a grippable handle. A space exists between the handle sections to receive the strap therethrough. The handle sections can be releasably attached to each other.

15 Claims, 25 Drawing Sheets

CLOSURE APPARATUS AND METHOD OF USING SAME

CROSS REFERENCE TO RELATED APPLICATIONS

This application claims benefit to U.S. Provisional Patent Application No. 61/790,335, filed Mar. 15, 2013, which is incorporated herein.

TECHNICAL FIELD AND BACKGROUND OF THE INVENTION

The present invention relates to a device that can be used to close previously opened packages and the like. One embodiment of the invention comprises an apparatus for securely closing previously opened food packaging, such as bags of potato chips and other snacks.

Many food stuffs, particularly snack foods such as chips and the like, are sold in large bags that are opened by tearing at the top of the bag. Typically, all of the contents of such large "family size" bags are not consumed immediately upon the initial opening of the bag in one sitting. Rather, there is often a substantial amount of contents remaining in the bag after the initial opening of the bag. Once opened, exposure of the bag's contents to air expedites spoiling of the contents. As such, there is a need for a means to keep the torn opening of the bag closed tightly to help keep the contents fresh.

Clip-like devices have been used to close opened food bags. However, the present invention provides advantages not present in such clip-like devices.

SUMMARY OF THE INVENTION

Therefore, one object of the present invention is to provide a device that can keep an opening of a package securely closed. Another object of the invention is to provide a device that can securely close the torn opening of a food bag to help keep the food fresh, and can be easily removed to reopen the bag and expose the contents at will. These and other objects of the invention can be obtained in the preferred embodiments of the invention described below.

A closure apparatus according to a preferred embodiment of the invention comprises a base having an upper surface and a lower surface, and first and second complementary handle sections attached to the base and extending upwardly from the upper surface of the base. The two handle sections together form a grippable handle and define a space therebetween for receiving a strap therethrough.

According to another embodiment of the invention, the lower surface of the base is concave.

According to another embodiment of the invention, the upper surface of the base is convex.

According to another embodiment of the invention, the two handle sections are arcuate.

According to another embodiment of the invention, a strap is attached to the base, the having a first fastener positioned at an end thereof, and a second fastener, the first and second fasteners adapted for complementary engagement.

According to another embodiment of the invention, the closure apparatus includes means for connecting the first and second handle sections together. As such, the first and second handle sections are moveable between an open position in which there is a space between the handle sections for receiving the strap therethrough, and a connected position in which the handle sections are connected to each other.

According to another embodiment of the invention the first handle section has a protruding member, and the second handle section has a recess shaped and sized to receive the protruding member so that the first handle section can be frictionally engaged to the second handle section.

According to another embodiment of the invention, the first and second handle sections are moveable between an open position in which the first and second handle sections define the space for receiving a strap therethrough to a connected position wherein the protruding member of the first handle section is positioned within the recess of the second handle section whereby the first and second handle sections are frictionally engaged.

According to another embodiment of the invention, the first handle section has a lower end attached to the upper surface of the base, and an upper end sloped in a first orientation. The second handle section has a lower end attached to the upper surface of the base, and an upper end sloped in a second orientation complementary to the first orientation of the sloped upper end of the first handle section.

According to another embodiment of the invention, a protruding member is formed on the upper end of the first handle section, and a recess shaped and sized to receive and engage the protruding member is formed in the upper end of the second handle section so that the first handle section can be frictionally engaged to the second handle section.

According to another embodiment of the invention, the upper end of the second handle section is positioned substantially above the upper end of the first handle section.

According to another embodiment of the invention, an apparatus for closing opened packaging comprises a base having an upper surface and a lower surface, a strap attached to the base, and first and second complementary handle sections attached to the base. The handle sections extend upwardly from the upper surface of the base, and together form a grippable handle. A space exists between the handle sections to receive the strap therethrough.

According to another embodiment of the invention, the lower surface of the base is concave to facilitate positioning of the lower surface of the base on a package.

According to another embodiment of the invention, a matrix of support members are formed in the base to provide structural reinforcement to the base.

According to another embodiment of the invention, a layer of rubber is attached to the lower surface of the base to position on a package opening. The rubber layer minimizes movement of the base when positioned on a package.

According to another embodiment of the invention, the strap has a first end attached to the base and a second end opposite to the first end. A first section of fasteners is positioned on a bottom surface of the strap proximate the second end, and a second section of fasteners positioned on a top surface of the strap. The first section of fasteners and the second section of fasteners are adapted for complementary engagement with each other.

According to another embodiment of the invention, the first section of fasteners is comprised of hook fasteners, and the second section of fasteners is comprised of loop fasteners.

A method of securely closing an opened package according to an embodiment of the invention comprises providing a closure device having a base having an upper surface and a lower surface, a strap having a first end attached to the base and a second end opposite to the first end, and a first section of fasteners positioned on a bottom surface of the strap proximate the second end, and a second section of fasteners positioned on a top surface of the strap. The first section of fasteners and the second section of fasteners are adapted for complementary engagement with each other. First and second complementary handle sections are attached to the base and extend upwardly from the upper surface of the base. The handle sections form a grippable handle and define a space therebetween for receiving the strap therethrough. The base is positioned over an opening in the package, and the strap is wrapped over the base and around the package. The strap is pulled through the space between the handle sections, and the first section fasteners are pressed against the second section fasteners to engage the first section fasteners and second section fasteners together.

According to another embodiment of the invention, the first handle section is attached to the second handle section, and the user grips the handle sections to carry the package.

DESCRIPTION OF PREFERRED EMBODIMENTS OF THE INVENTION AND BEST MODE

Figure 1:
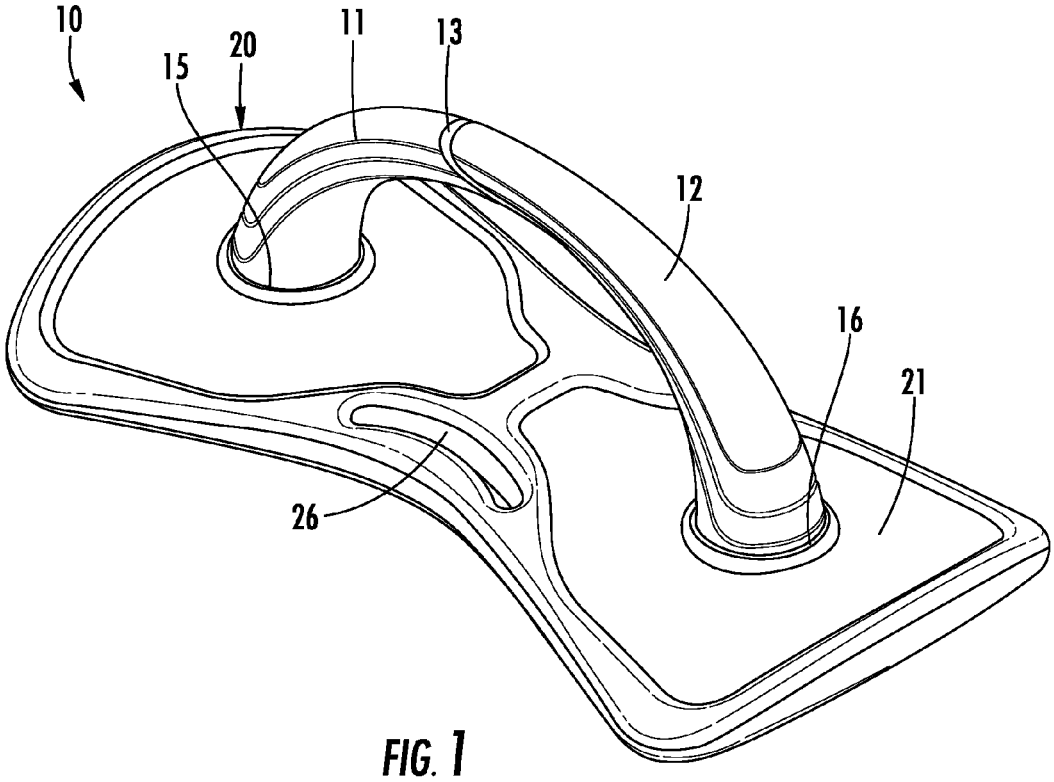
FIG. 1 is a perspective view of a closure apparatus according to a preferred embodiment of the invention.
Figure 2:
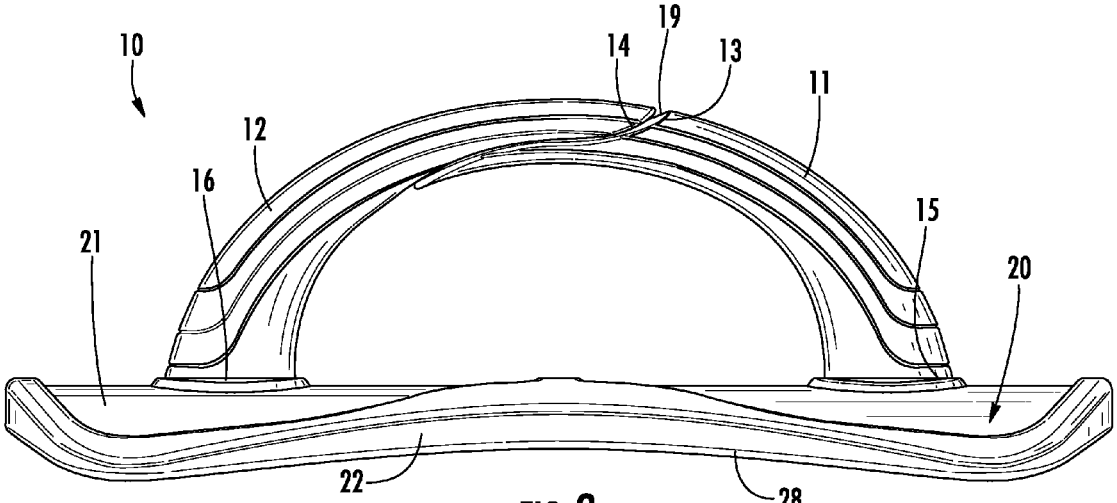
FIG. 2 is side elevation of the closure apparatus of FIG. 1.
Figure 3:
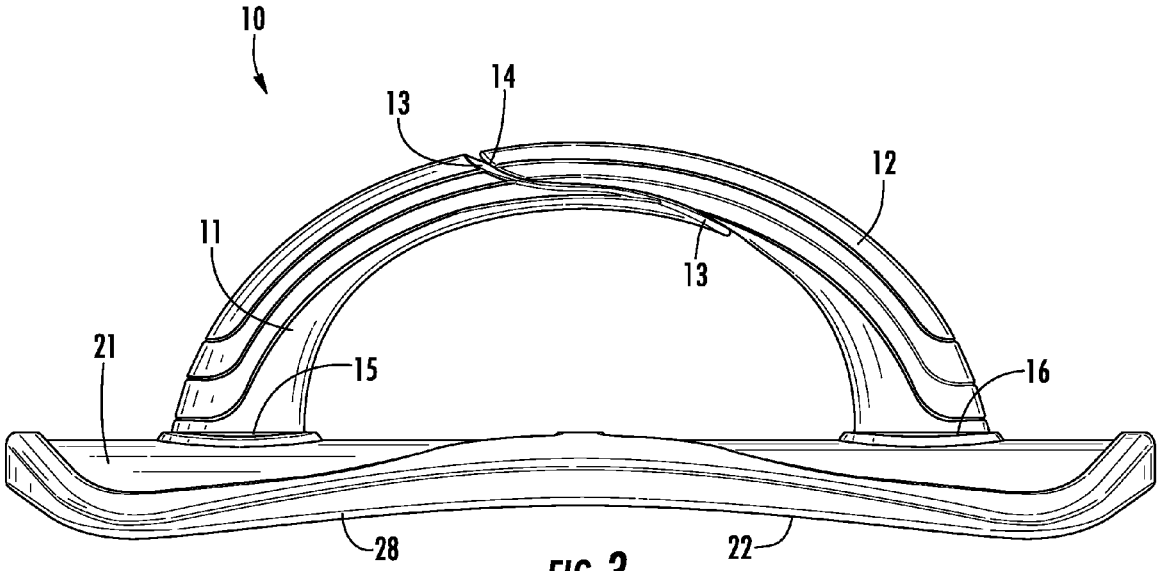
FIG. 3 is another side elevation of the closure apparatus of FIG. 1.

A bag closure apparatus 10 according to a preferred embodiment of the invention is illustrated in FIGS. 1-12, and shown generally at reference numeral 10. As shown in FIGS. 1-3, the apparatus 10 comprises first and second handle sections 11, 12 mounted on a base 20.

Figure 4:
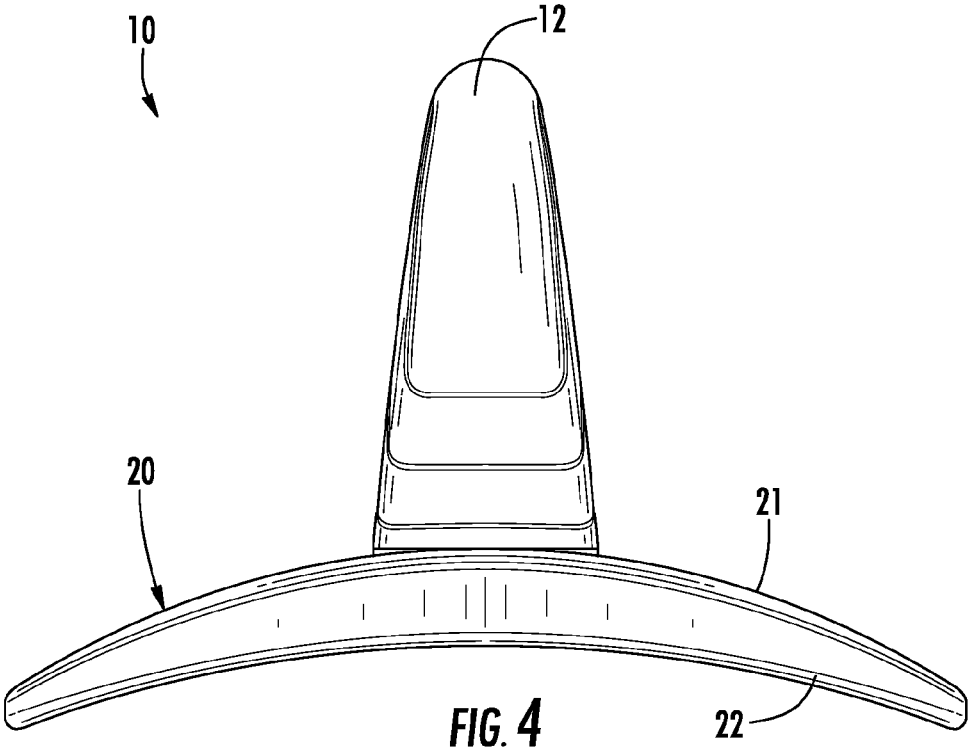
FIG. 4 is an end view of the closure apparatus of FIG. 1.
Figure 5:
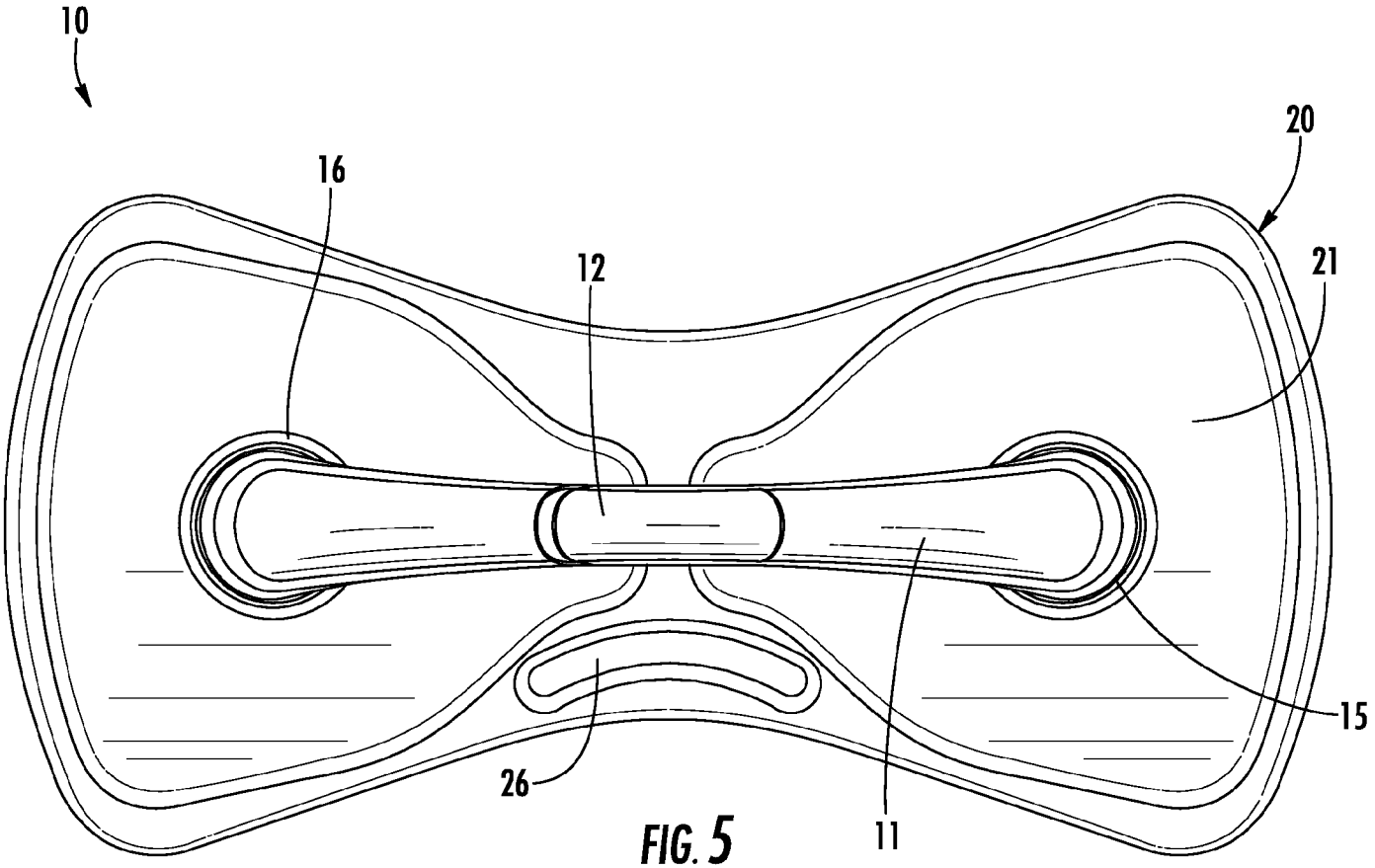
FIG. 5 is a top plan view of the closure apparatus of FIG. 1.
Figure 6:
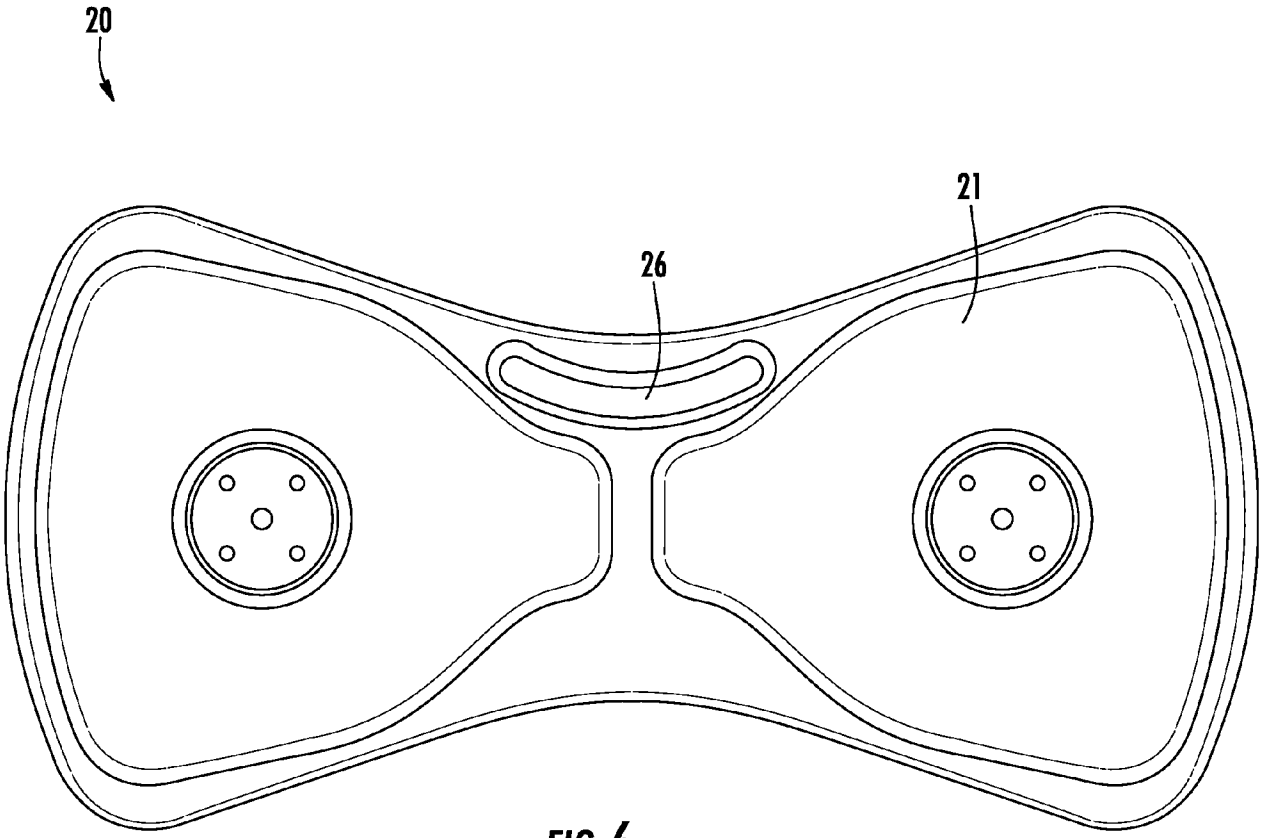
FIG. 6 is a top plan view of the base of the closure apparatus of FIG. 1.
Figure 7:
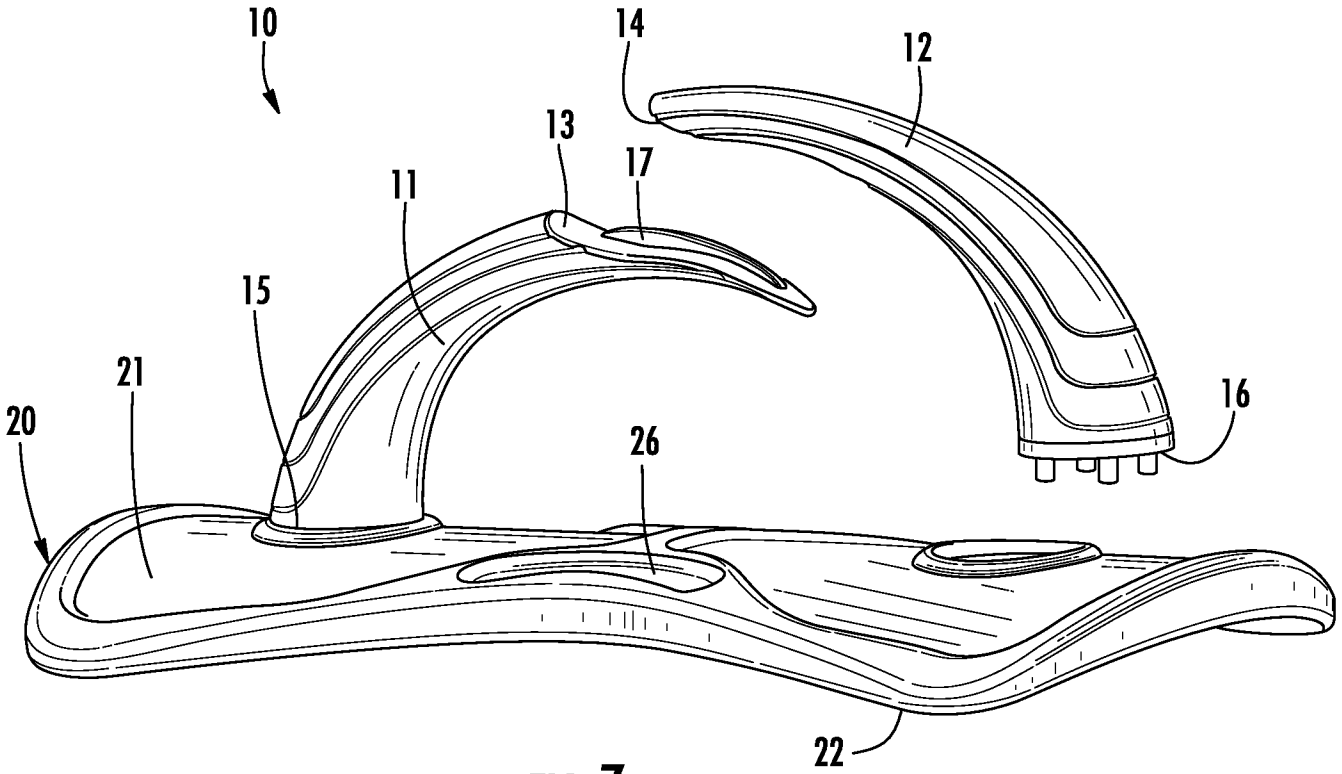
FIG. 7 is an exploded perspective view of the closure apparatus of FIG. 1.
Figure 8:
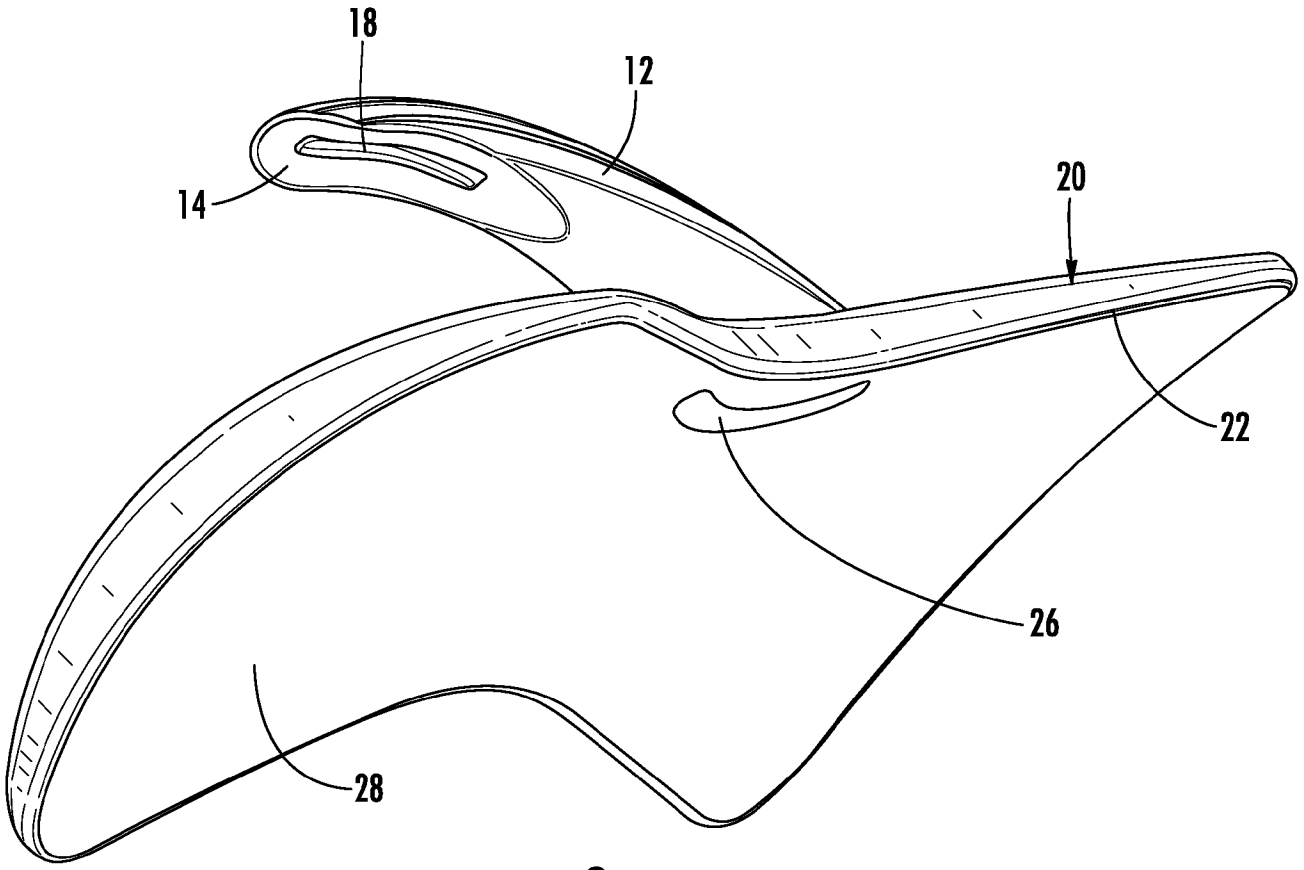
FIG. 8 is a partial perspective view of the closure apparatus of FIG. 1.
Figure 9:
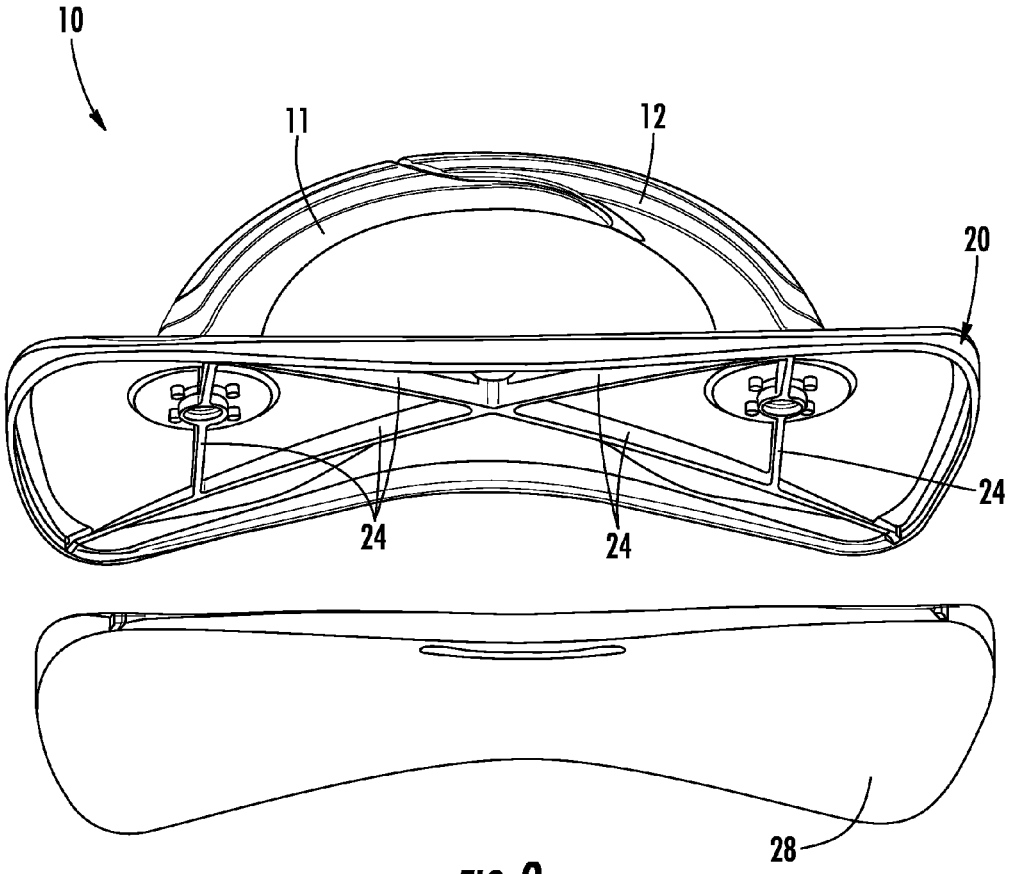
FIG. 9 is an exploded perspective view of the closure apparatus of FIG. 1.

The base 20 has an upper surface 21 and a bottom surface 22. As shown in FIG. 4, the bottom surface 22 is concave, and the upper surface 21 is convex. The base 20 can include a matrix of support members 24 formed in the base 20 that provide structural reinforcement to the base 20, as shown in FIG. 9.

Each handle section 11, 12 has an upper end 13, 14, respectively, and a lower end 15, 16, respectively. The lower ends 15, 16 of the handle sections 11, 12 are mounted on the upper surface 21 of the base 20, and the handle sections 11, 12 extend upwardly from the upper surface 21 of the base 20, as shown in FIGS. 2 and 3. The handle sections 11, 12 can be attached to the base 20 by fasteners such as screws that are screwed through the bottom surface 22 of the base 20 and through the lower ends 15, 16 of the handle sections 11, 12. Alternatively, the handle sections 11, 12 can be attached to the base 20 by other means, such as heat staking, ultrasonic welding or adhesives.

The handle sections 11, 12 and base 20 can be made of acrylonitrile butadiene styrene (ABS) plastic or other suitable material. The handle sections 11, 12 and base 20 can be made using injection molding, three dimensional printing, or other suitable manufacturing process.

The handle sections 11, 12 can be arced toward each other such that the upper end 13 of the first handle section 11 faces the upper end 14 of the second handle section 12, as shown in FIGS. 2 and 3. The upper ends 13, 14 of the handle sections 11, 12 define a passage space 19 therebetween, as shown in FIGS. 2 and 3. The arcuate handle sections 11, 12 together form a single grippable handle. Grooves can be formed on the exterior of the handle sections 11, 12 to provide texture and comfort when gripping the handle sections 11, 12.

The upper ends 13, 14 of the handle sections 11, 12 can be contoured in complementary orientations, as shown in FIGS. 2 and 3. The upper end 13 of the first handle section 11 can be sloped in a first orientation, such as the upward slope shown in FIG. 7, and the upper end 14 of the second handle section 12 can be sloped in a second orientation complementary to the upper end 13 of first handle section, such as the downward slope shown in FIG. 8. As such, the upper end 14 of the second handle section 12 is disposed substantially above the upper end 13 of the first handle section 11, as shown in FIGS. 2 and 3.

The apparatus 10 can include attachment means for connecting the handle sections 11, 12 together. The attachment means can be comprised of a protruding member such as a nodule 17 formed on the upper end 13 of the first handle section 11, shown in FIG. 7, and a recess such as a cavity 18 formed in the upper end 14 of the second handle section, shown in FIG. 8. The cavity 18 is shaped and sized to receive and frictionally engage the nodule 17. Positioning the nodule 17 in the cavity 18 connects the handle sections 11, 12 to each other, closing the passage space 16 between the handle sections 11, 12. As such, the handle sections 11, 12 can be moved from an open position in which the passage space 19 exists between the handle sections 11, 12, and a connected position in which the handle sections 11, 12 are connected to each other by positioning the cavity 18 of the second handle section 12 over the nodule 17 of the first handle section 11.

Figure 10:
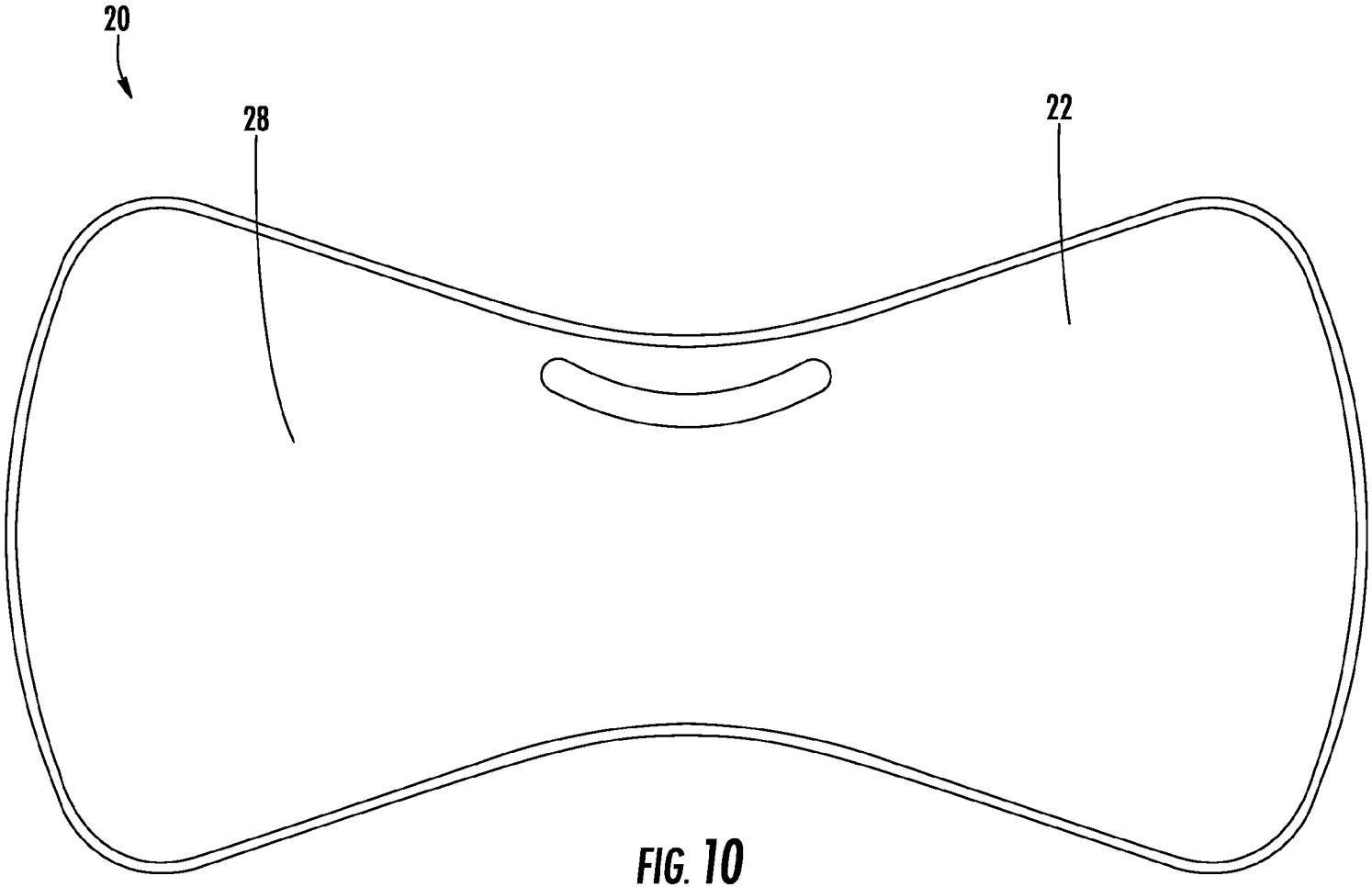
FIG. 10 is a bottom plan view of the closure apparatus of FIG. 1.
Figure 11:
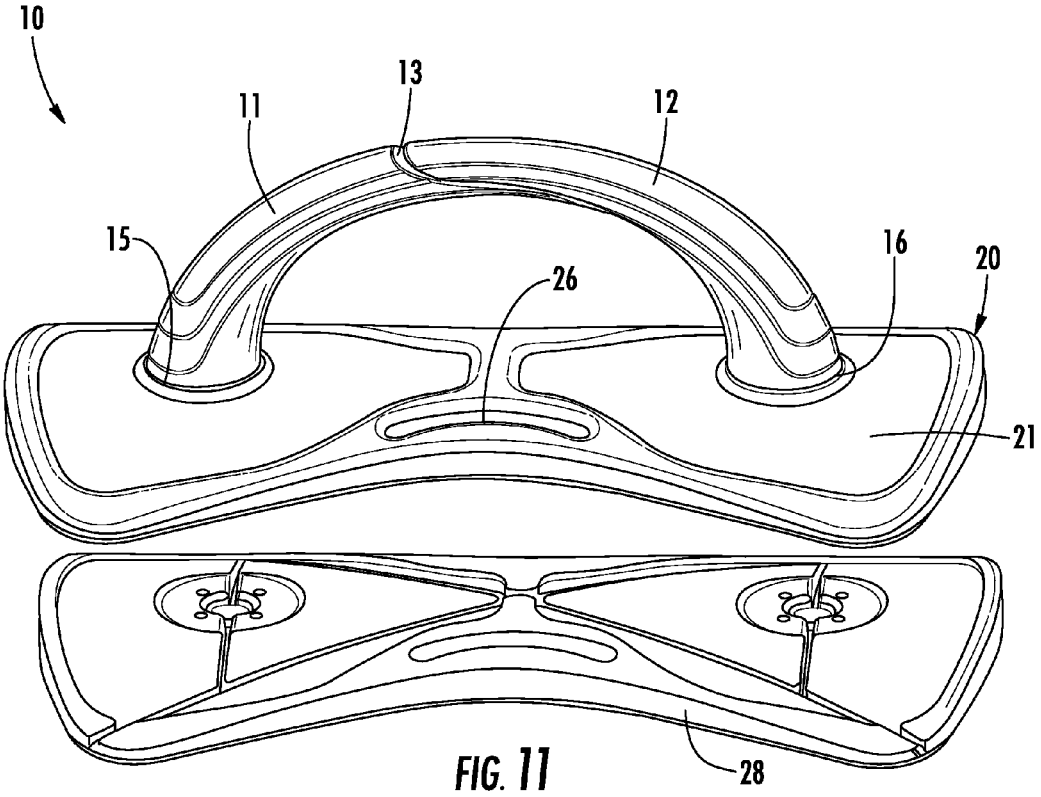
FIG. 11 is an exploded perspective view of the closure apparatus of FIG. 1.

An anti-slip cover layer 28 can be positioned on the bottom surface 22 of the base 20, as shown in FIGS. 10 and 11. The cover layer 28 can be comprised of rubber or other material that minimizes slippage on packaging materials such as paper, cardboard and plastic typically used for bags, boxes, and other packaging.

Figure 12:
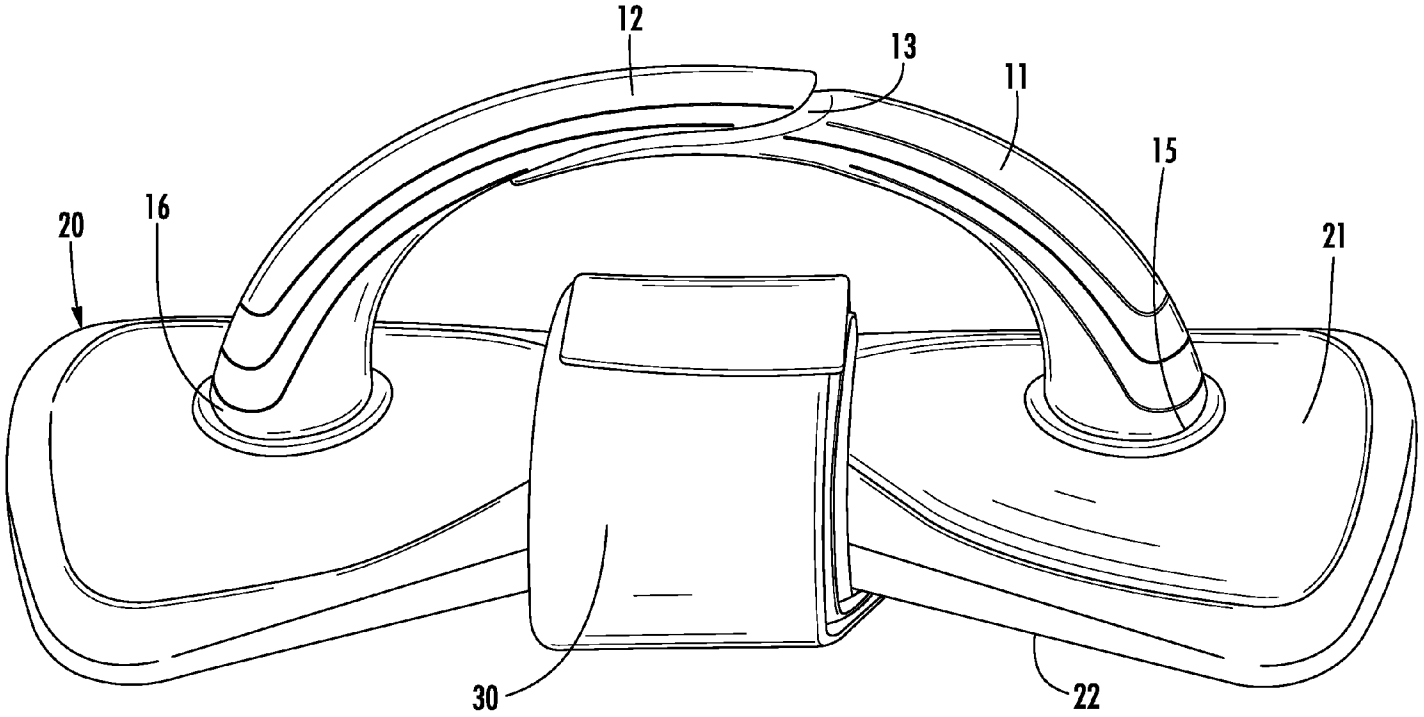
FIG. 12 is a perspective view of the closure apparatus of FIG. 1.
Figure 13:
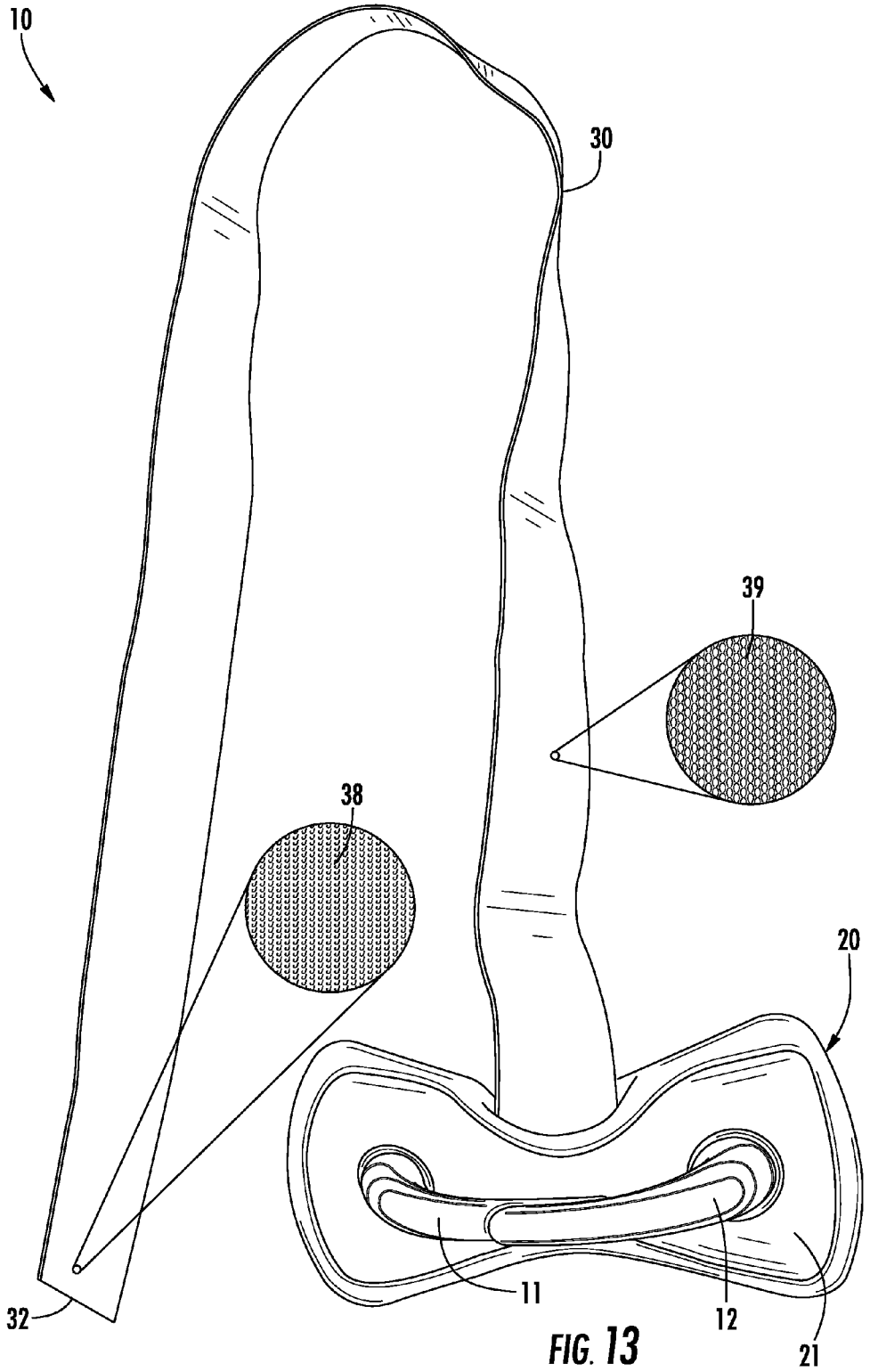
FIG. 13 is another perspective view of the closure apparatus of FIG. 1.

The apparatus 10 can include an elongate substantially flat strap 30 attached to the base 20, as shown in FIGS. 12 and 13. The strap 30 can be made of an elastic material. An aperture 26 can be formed through the base 20, and the strap 30 can be attached by inserting one end 31 of the strap 30 through the aperture 26, and sewing the end 31 to the underside of the strap 30. Alternatively, an adhesive can be used to attach the end 31 to the underside of the strap 30, or the strap 30 can be attached to the base 20 by other attachment means, such as a bungee cord hook. The strap 30 can be wound around the base 20 for storage, as shown in FIG. 12.

The strap 30 can include means for releasably attaching the strap 30 to itself. As shown in FIG. 13, the strap 30 can have a first section of fasteners 38 positioned on the underside of the strap 30 proximate the end 32 of the strap 30, and a second section of complementary fasteners 39 on the opposite side of the strap 30. The first section fasteners 38 and the second section fasteners 39 comprise fasteners adapted for complementary engagement with each other, such as hook and loop fasteners. The first section of fasteners 38 can be comprised of a plurality of hook fasteners, and the second section of fasteners can be comprised of a plurality of loop fasteners. As such, the first section of fasteners 38 can frictionally engage the second section of fasteners 39 at any point on the strap 20. The first section of fasteners 38 can be easily released from engagement with the strap 20 by pulling on the end 32 of the strap away from the point of engagement with the strap 20. Alternatively, the first section of fasteners 38 can be comprised of loop fasteners, and the second section of fasteners 39 can be comprised of hook fasteners.

A method of using the closure apparatus 10 according to a preferred embodiment of the invention is illustrated in FIGS. 14-20. The closure apparatus 10 can be used to securely close opened packaging. As used throughout this application, "packaging" refers generally to any type of package that can contain items, including but not limited to bags, boxes, pouches and other containers.

Figure 14:
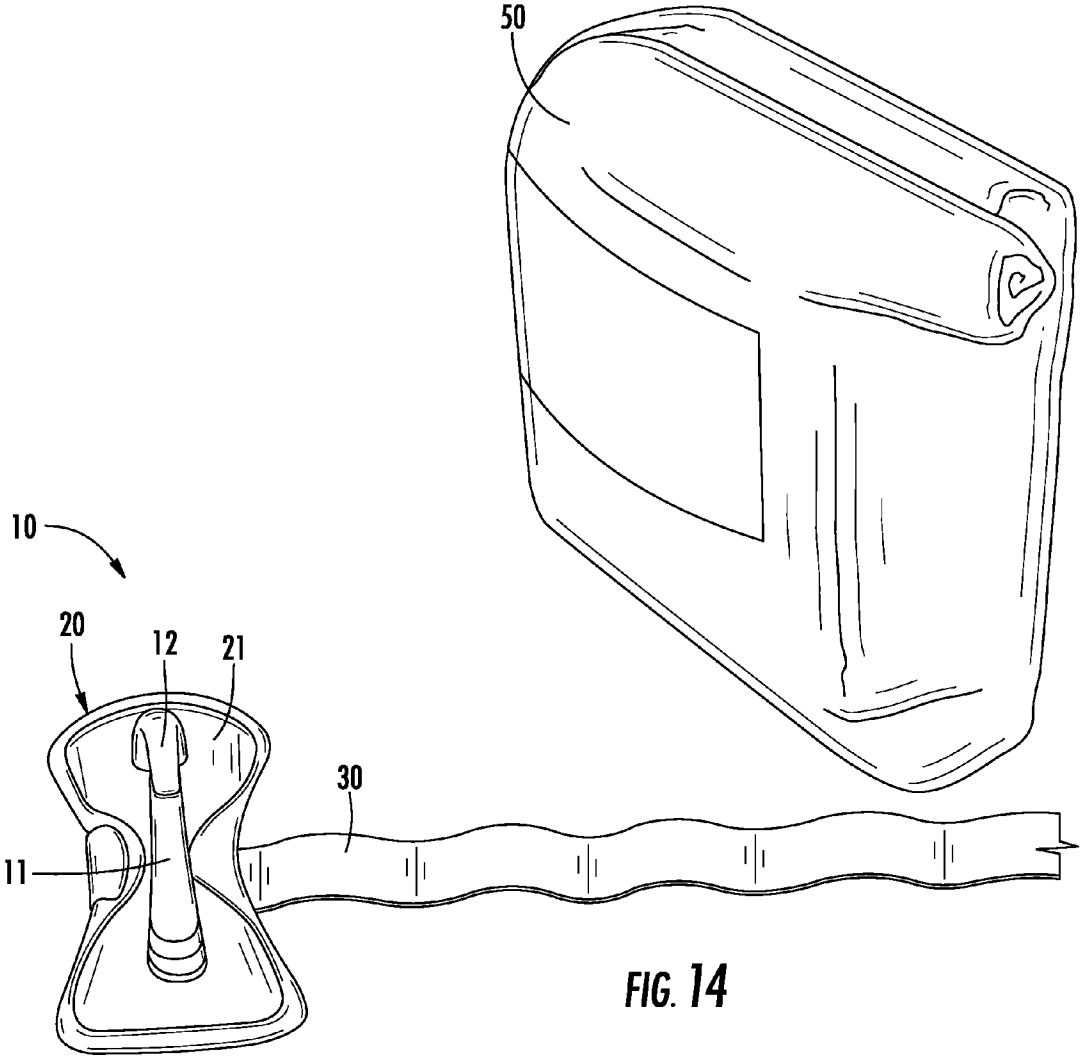
FIG. 14 is an environmental perspective view of the closure apparatus of FIG. 1.
Figure 15:
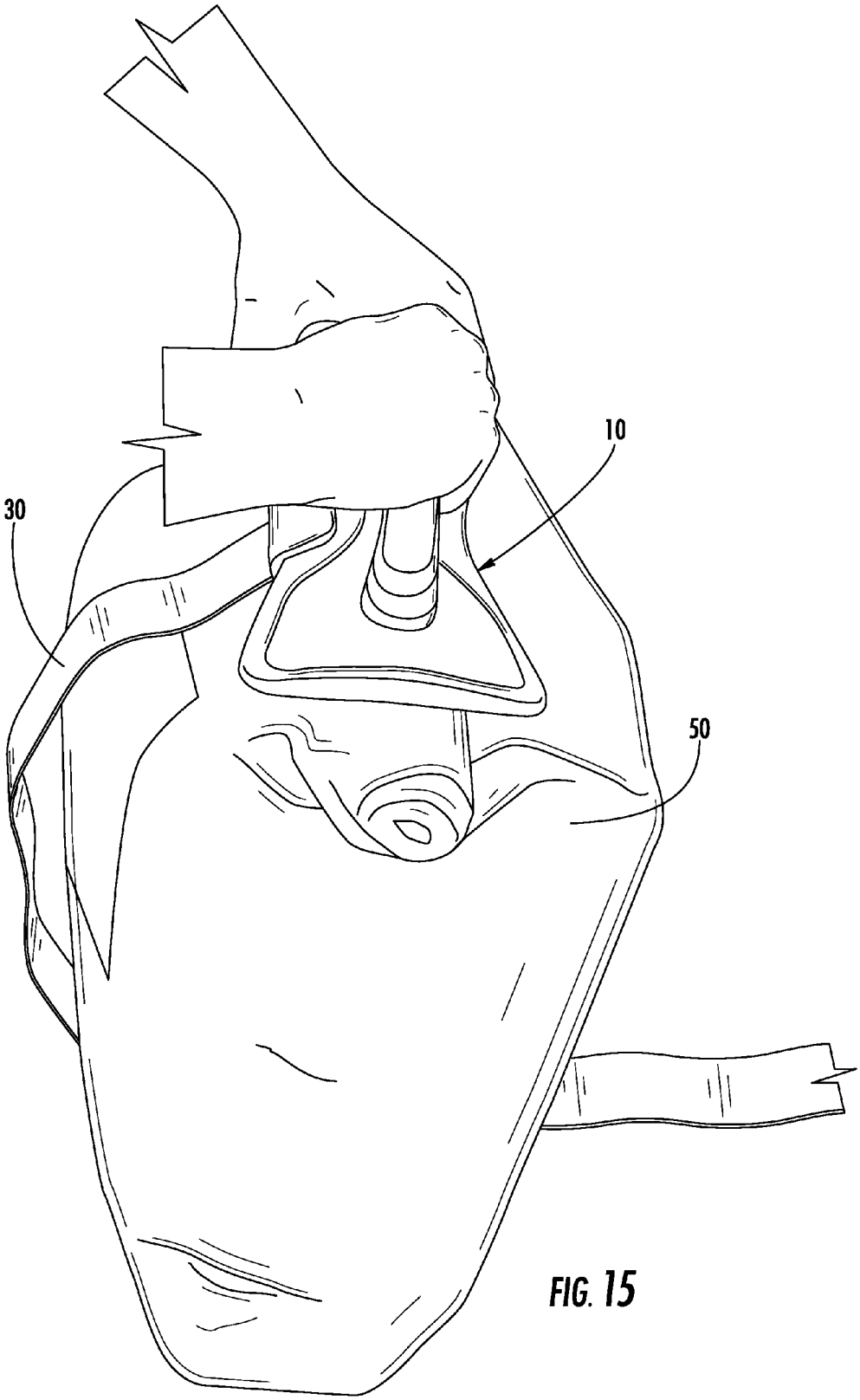
FIG. 15 is another environmental perspective view of the closure apparatus of FIG. 1.
Figure 16:
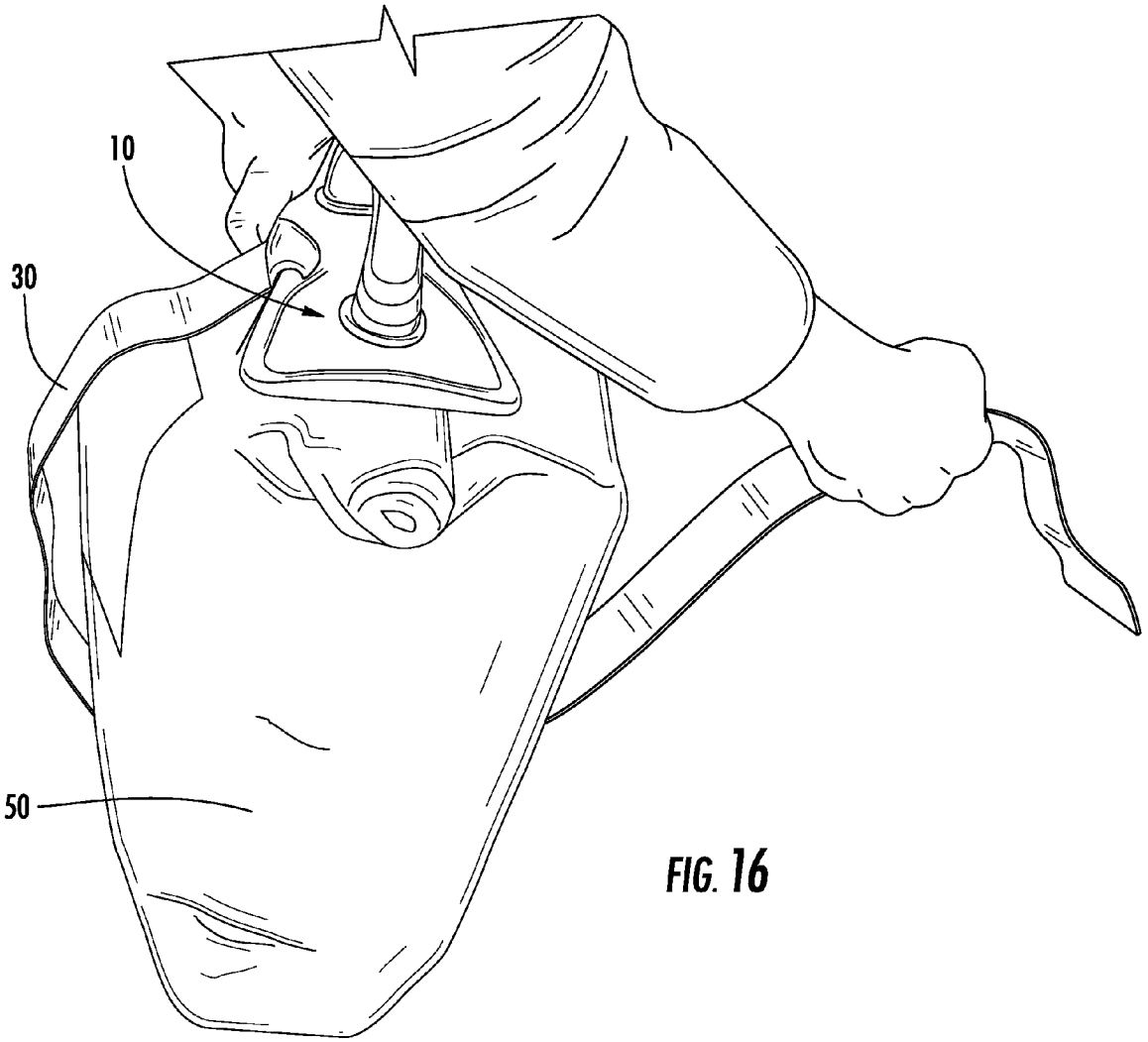
FIG. 16 is another environmental perspective view of the closure apparatus of FIG. 1.
Figure 17:
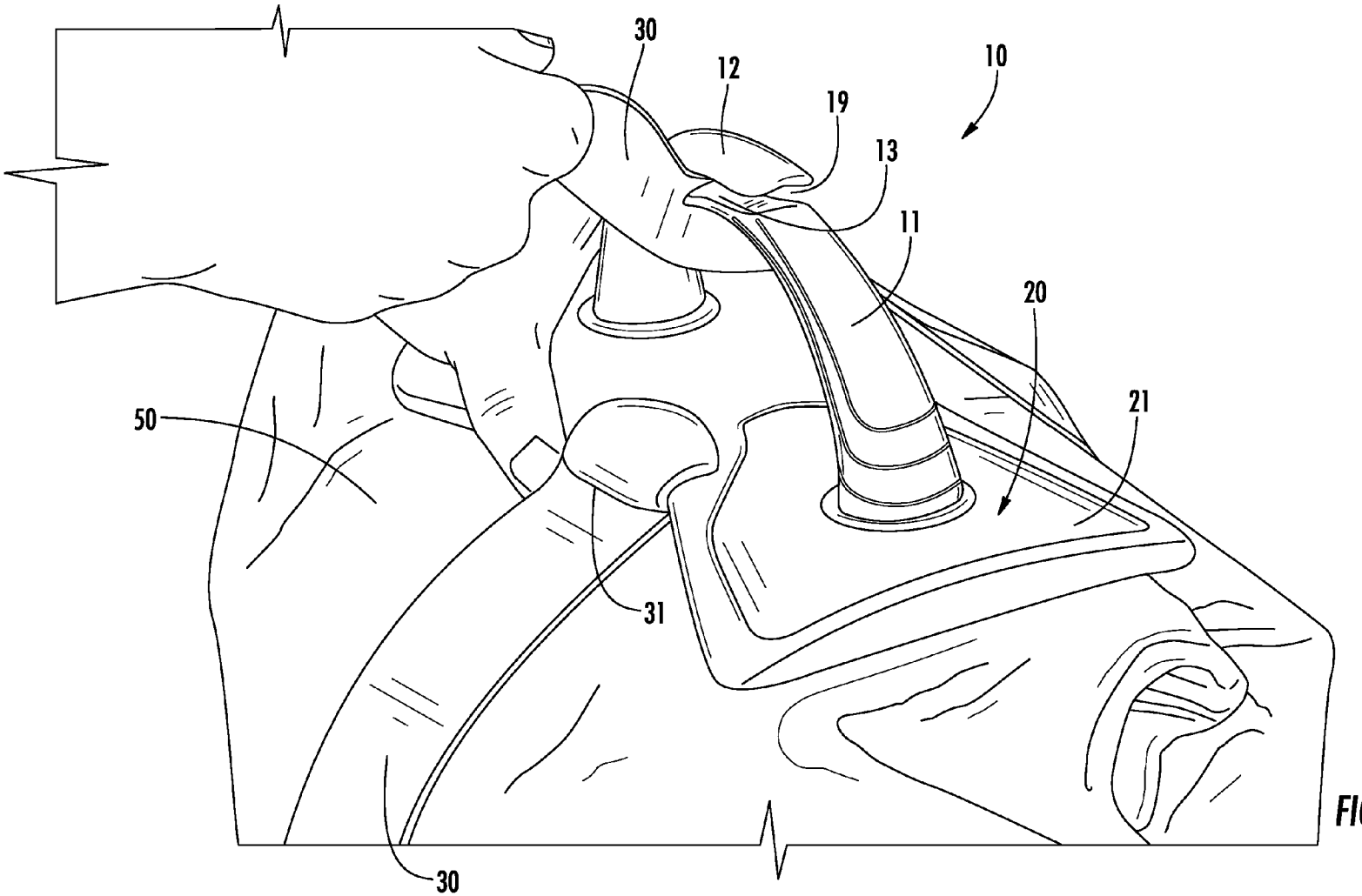
FIG. 17 is another environmental perspective view of the closure apparatus of FIG. 1.
Figure 18:
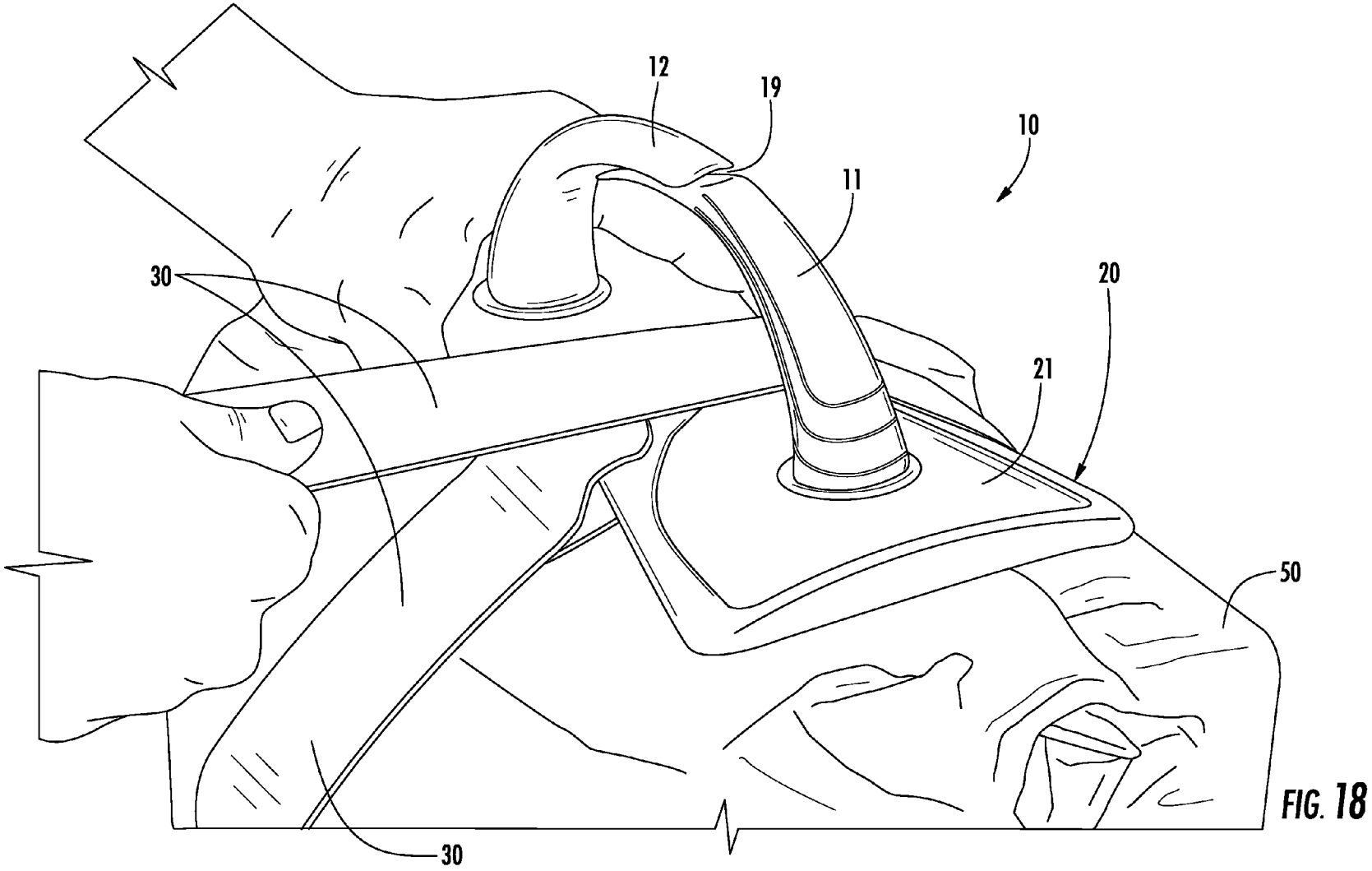
FIG. 18 is another environmental perspective view of the closure apparatus of FIG. 1.
Figure 19:
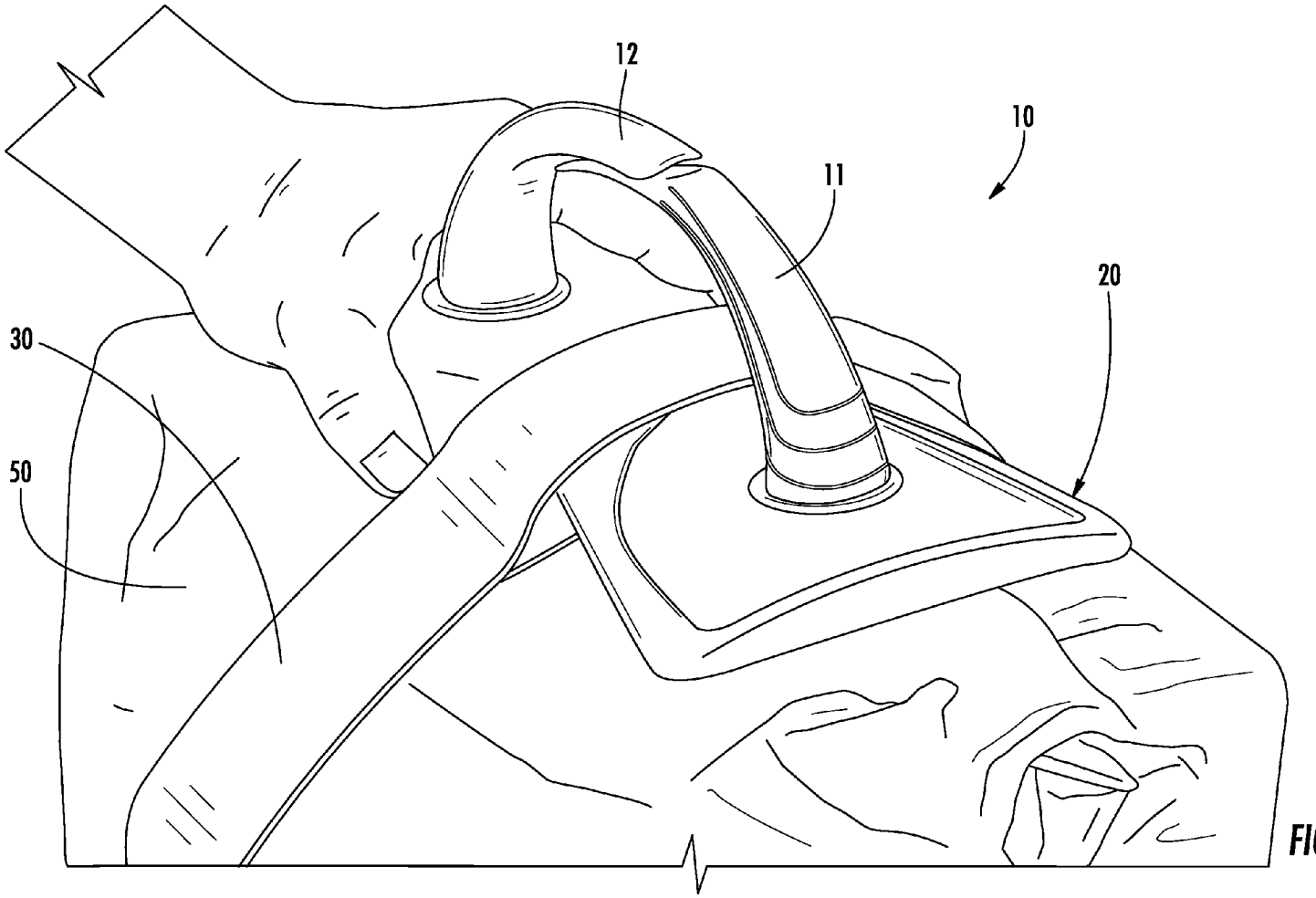
FIG. 19 is another environmental perspective view of the closure apparatus of FIG. 1.

As shown in FIGS. 14-20, the apparatus 10 can be used to close packaging such as a previously opened dog food bag 50. The strap 30 is fully extended from the base 20, and the bag 50 is placed on the underside of the strap 30 and the base 20 is positioned on the top of the bag, as shown in FIGS. 14 and 15. The concave bottom surface 22 of the base 20 and the anti-slip cover layer 28 helps maintain the base 20 securely on the bag 50. The strap 30 is grasped proximate the end 32 and pulled around the bag 50, as shown in FIG. 16. The strap 30 is pulled over the base 20 and inserted through the passage space 19 of the handle sections 11, 12, as shown in FIG. 17. The strap 30 is pulled downward until the strap 30 is taut and the bag 50 is tightly closed, as shown in FIG. 18. The hook fasteners 38 on the underside of the strap 30 are pressed down against the loop fasteners 39 on the upperside of the strap 30, as shown in FIG. 19. As such, the hook fasteners 38 frictionally engage the loop fasteners 39, and the bag 50 is securely bound by the strap 30. As such, the base 20 serves as surface area keeping the contents of the bag 50 fresh, as the strap 30 applies tension maintaining closure.

Figure 20:
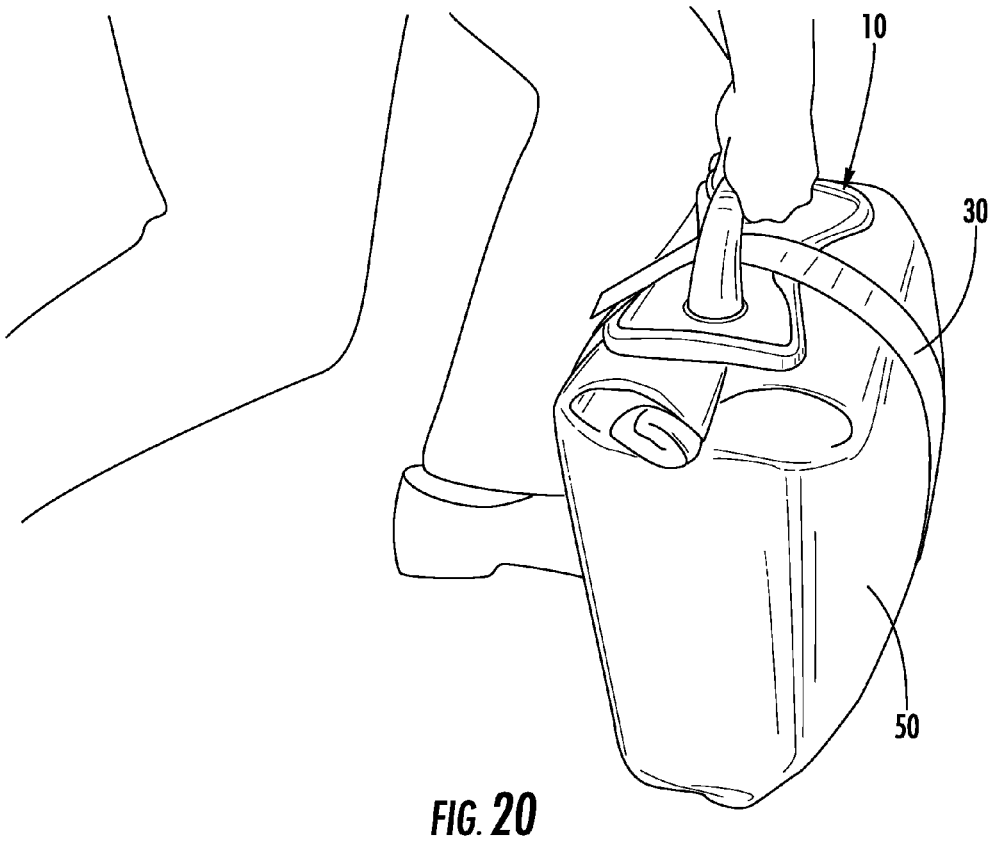
FIG. 20 is another environmental perspective view of the closure apparatus of FIG. 1.

The handle sections 11, 12 are then moved from the open position to the closed position by pressing the cavity 18 of the second handle section 12 onto the nodule 17 of the first handle section 11, thereby securely locking the handle sections 11, 12 together. The connected handle sections 11, 12 form a single handle that can be grasped by the user, and used to lift and transport the securely bound bag 50, as shown in FIG. 20. Also, the lifting of the handle sections 11, 12 urges the nodule 17 of the first handle section 11 upward into the cavity 18 of the second handle section to further facilitate engagement of the handle sections 11, 12 together in the closed position.

Because the strap 30 is stretchable and the hook fasteners 38 can be attached at any position on the strap 30, the apparatus 10 can be used with a variety of sizes of bags. For example, the strap 30 can be wound around the packaging and through the passage space 19 multiple times to close smaller packaging. In addition, the adjustable nature of the apparatus 10 enables the apparatus 10 to conform to the decreasing volume of the bag 50 as its contents are consumed over time. So for example, as dog food from the bag 50 is consumed, the strap 30 can be pulled farther so that there is increased tension and the base 20 is forced downwardly with greater pressure to accommodate the decrease in volume of the bag 50 due to the consumption of food within the bag 50. Furthermore, the adjustable nature of the strap 30 allows the user to determine the level of tension that is applied to the bag 50 so that the contents of the bag 50 are not crushed.

The separable handle sections 11, 12 provide a more efficient means of closing and sealing the bag 50 than would a device with a single inseparable handle by providing a means to easily and quickly slip the strap 30 between the handle sections 11, 12 rather than having to try to push the end 32 of the strap 30 underneath a single inseparable handle. In addition, the handle sections 11, 12 enables users to apply better tension to the strap 30 to create a tighter seal than what would be obtained using a single inseparable handle. A single molded handle would increase the time it takes to secure the apparatus on the bag 50, and would often result in the hook fasteners 38 engaging the loop fasteners 39 at unintended areas of the strap 30.

A brand logo, advertising or other decorative insignia can be imprinted on the upper surface 21 of the base 20. As such, the base 20 can provide a means for promoting a brand or business relating to the bag 50.

It should be noted that while the closure apparatus 10 is described above as being used with a dog food bag 50, the invention is not so limited. The apparatus 10 can be used to close a variety of food packaging, including but not limited to, all types of snack foods in bag storage containers, cereal bags, bags of rice, bags of dry pet food, bird seed bags, cookie bags, snack foods boxes, frozen foods bags, mesh bags for produce such as oranges, bags used by restaurants to store durable goods. The apparatus 10 can also be used outside of the food industry and has applications other than closing packaging. For example, the apparatus 10 can be used to bundle items together such as wood logs, pipes, and the like. The apparatus 10 can be used to keep a charcoal bag or salt bag (road salt) closed after opening.

The apparatus 10 can provide a more efficient option to other devices in the bag closure field, particularly in comparison to known potato chip clips. The apparatus 10 can provide a more durable option without fewer moving parts than a typical chip clip, and therefore is less likely to break. The stretchable strap 30 helps keep the contents of the bag 50 fresher longer by providing a generally tighter closure, and can be less prone to falling off through user error.

Figure 21:
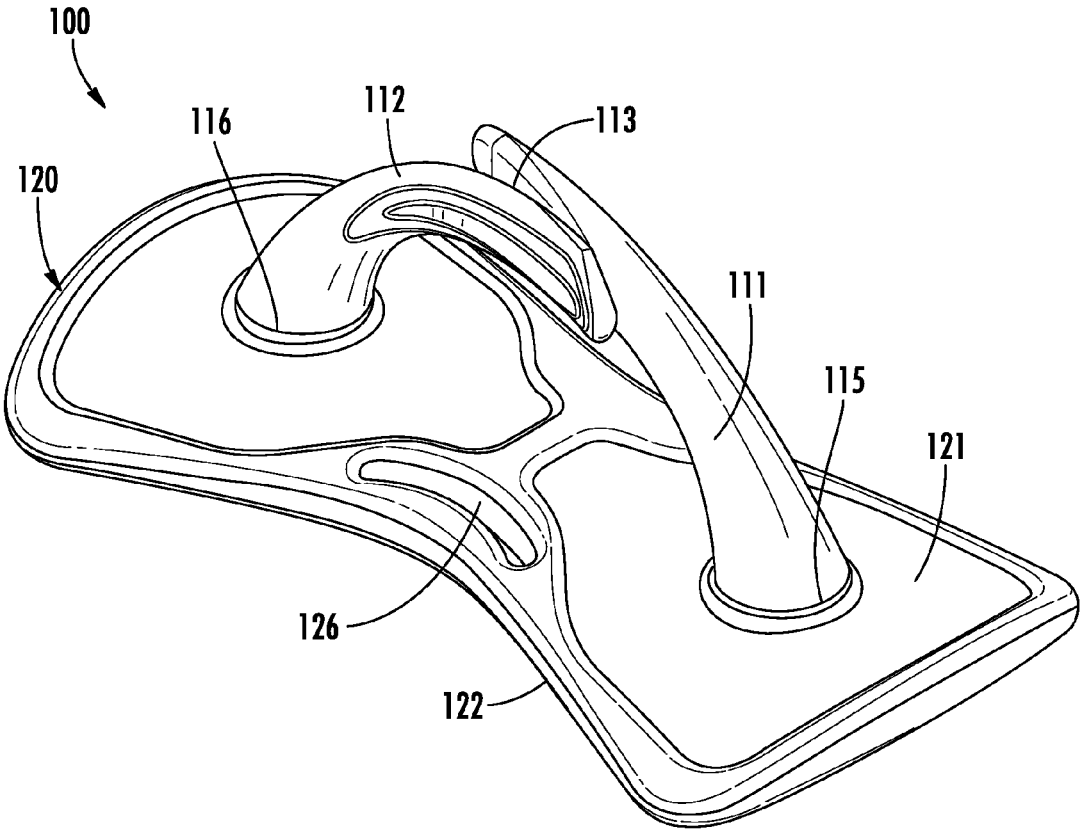
FIG. 21 is a perspective view of a closure apparatus according to another preferred embodiment of the invention.

A closure apparatus according to another preferred embodiment of the invention is illustrated in FIGS. 21-25, and shown generally at reference numeral 100. As shown in FIG. 21, the apparatus 100 comprises first and second handle sections 111, 112 mounted on a base 120. The apparatus 100 is identical in structure to the previously described closure apparatus 10, except for the orientation of the handle sections 111, 112.

Figure 22:
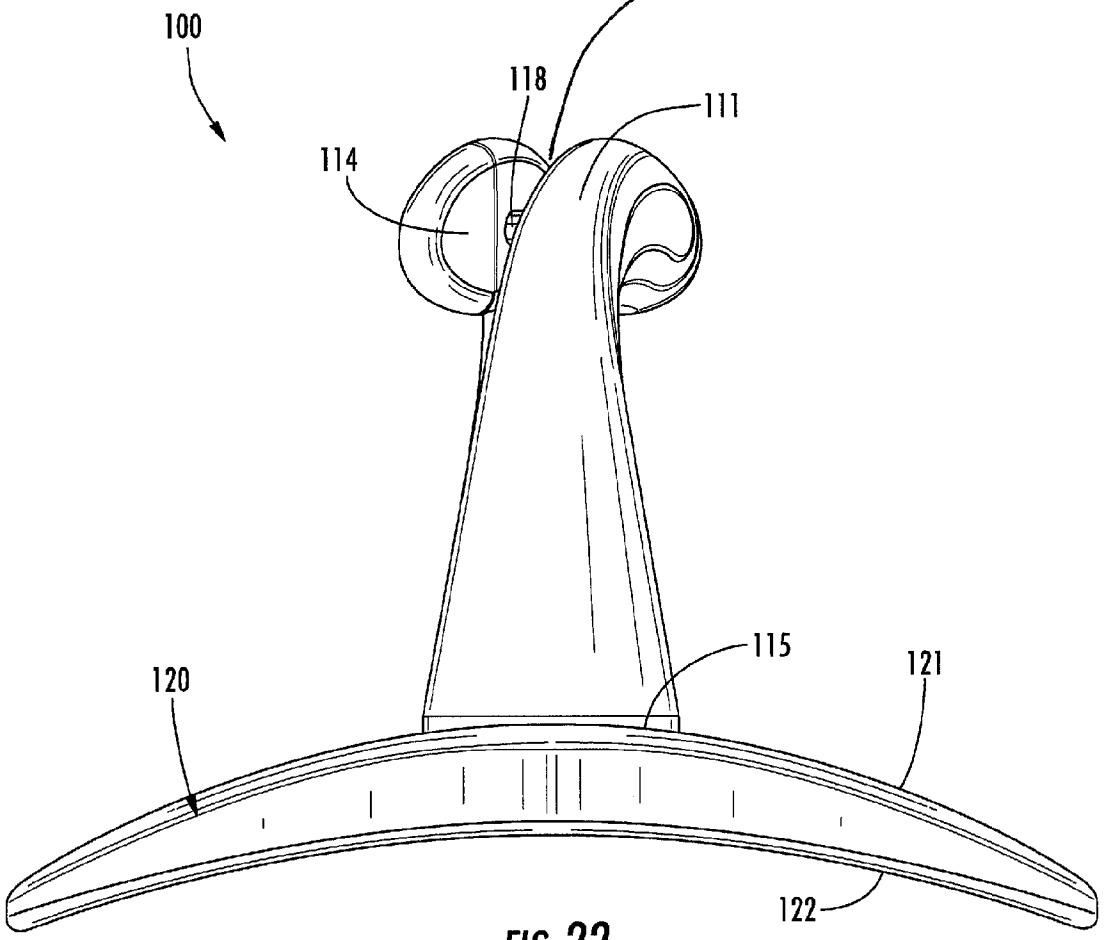
FIG. 22 is an end view of the closure apparatus of FIG. 21.

The base 120 has an upper surface 121 and a bottom surface 122. As shown in FIG. 22, the bottom surface 122 is concave, and the upper surface 121 is convex. The base 120 can include a matrix of support members 124 formed in the base that provide structural reinforcement to the base 120. An aperture 126 can be formed through the base 120, and can receive a strap therethrough.

Figure 24:
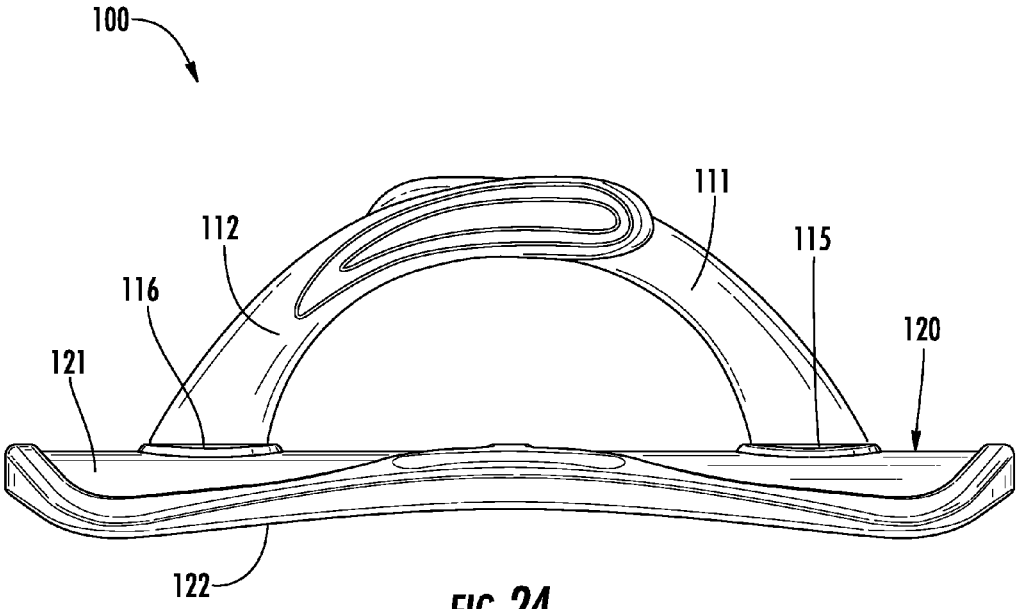
FIG. 24 is a side elevation of the closure apparatus of FIG. 21.

Each handle section 111, 112 has an upper end 113, 114, respectively, and a lower end 115, 116, respectively. The lower ends 115, 116 of the handle sections 111, 112 are mounted on the upper surface 121 of the base 120, and the handle sections 111, 112 extend upwardly from the upper surface 121 of the base 120, as shown in FIG. 24. The handle sections 111, 112 can be attached to the base 120 by fasteners such as screws that are screwed through the bottom surface 122 of the base 120 and through the lower ends 115, 116 of the handle sections 111, 112. Alternatively, the handle sections 111, 112 can be attached to the base 120 by other means, such as heat staking, ultrasonic welding or adhesives.

The handle sections 111, 112 can be arced toward each other such that the upper end 113 of the first handle section 111 faces the upper end 114 of the second handle section 12, as shown in FIGS. 21-24. The upper ends 113, 114 of the handle sections 111, 112 define a passage space 119 therebetween, as shown in FIG. 22. The arcuate handle sections 111, 112 together form a single grippable handle.

Figure 23:
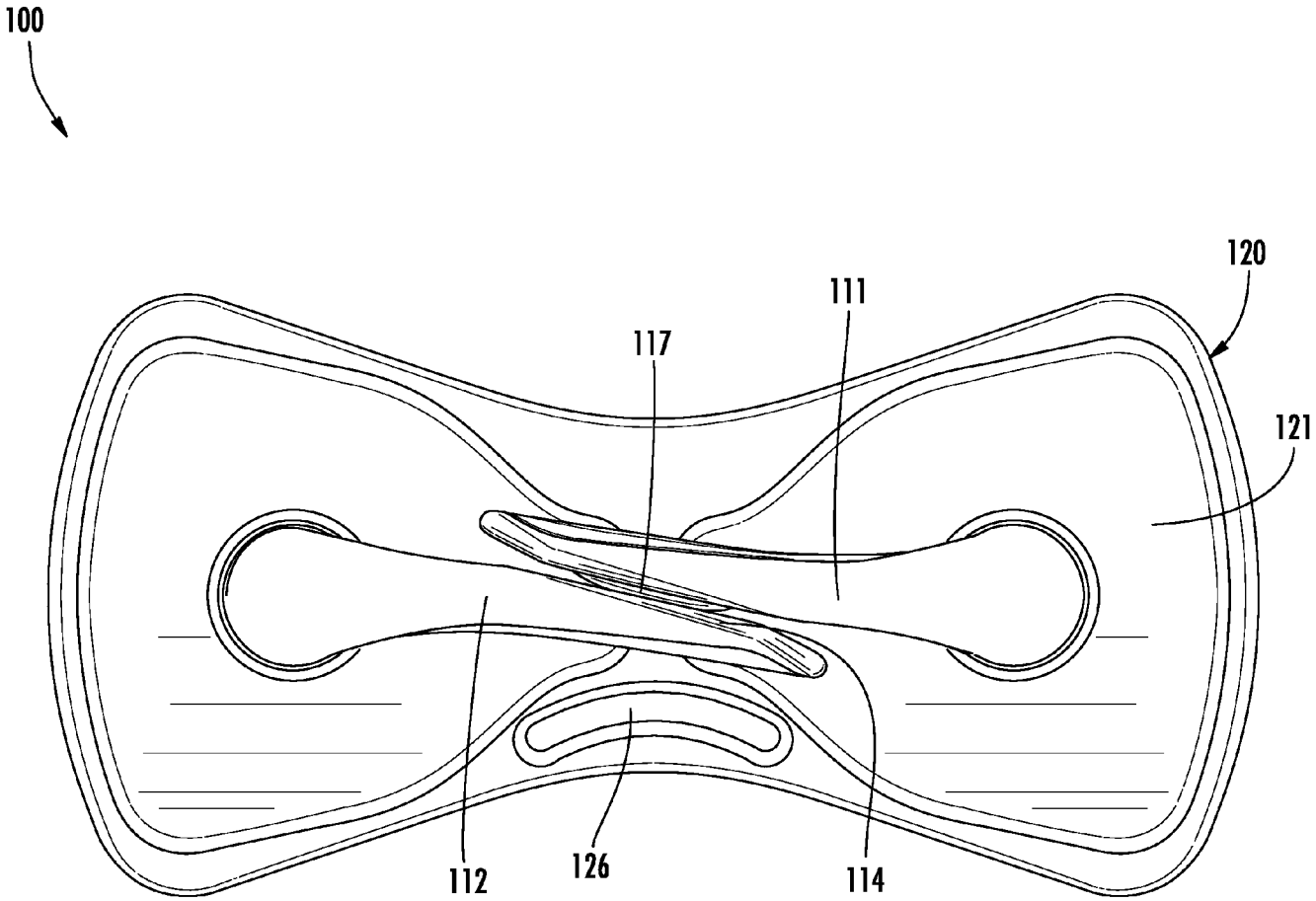
FIG. 23 is a top plan view of the closure apparatus of FIG. 21.

The upper ends 113, 114 of the handle sections 111, 112 can be contoured in complementary orientations. As shown in FIGS. 21-23, the upper end 113 of the first handle section 111 faces the upper end 114 of the second handle section 112.

Figure 25:
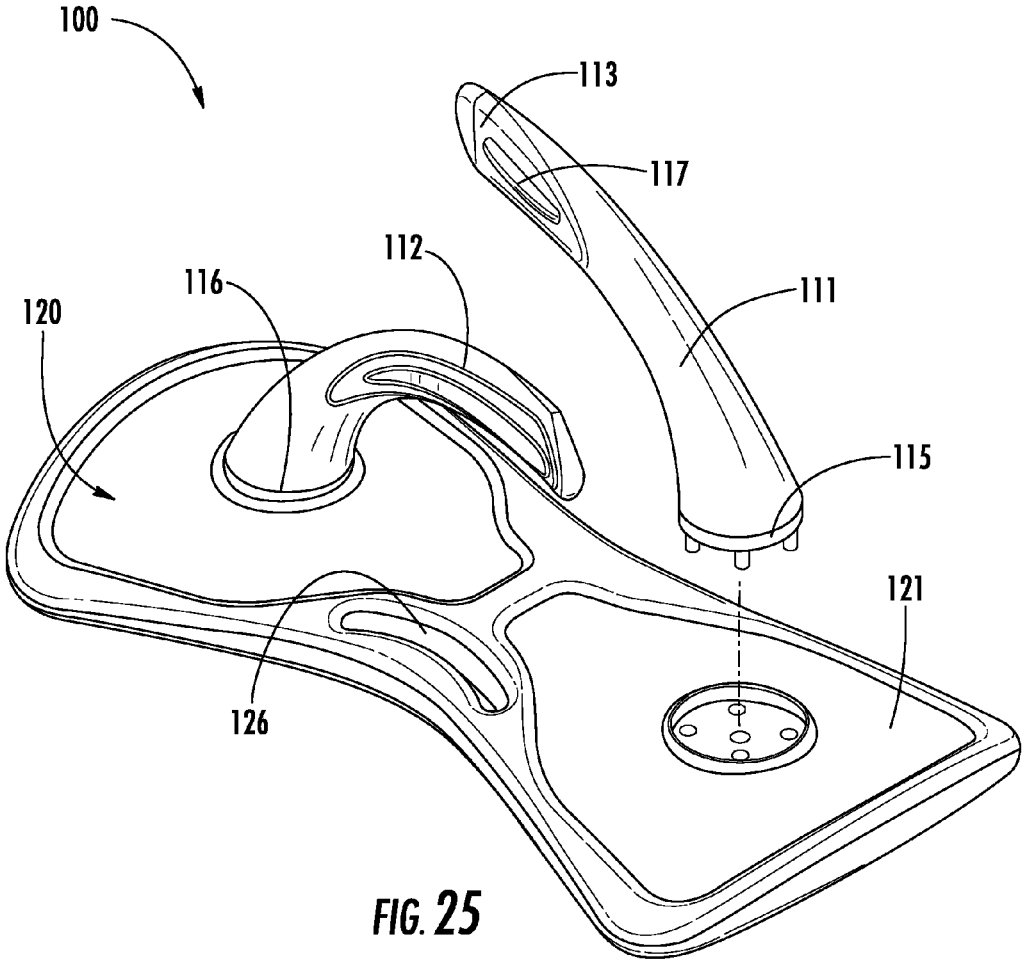
FIG. 25 is an exploded perspective view of the closure apparatus of FIG. 21.

The apparatus 100 can include attachment means for connecting the handle sections 111, 112 together. As shown in FIGS. 23 and 25, the attachment means can be comprised of a protruding member such as a nodule 117 formed on the upper end 113 of the first handle section 111, and a recess such as a cavity 118 formed in the upper end 114 of the second handle section 112. The cavity 118 is shaped and sized to receive and frictionally engage the nodule 117. Positioning the nodule 117 in the cavity 118 connects the handle sections 111, 112 to each other, closing the passage space 119 between the handle sections 111, 112. As such, the handle sections 111, 112 can be moved from an open position in which the passage space exists between the handle sections 111, 112, and a connected position in which the handle sections 111, 112 are connected to each other by positioning the nodule 117 of the first handle section 111 into the cavity 118 of the second handle section 112.

A closure apparatus and method of using same are described above. Various changes can be made to the invention without departing from its scope. The above description of the preferred embodiments and best mode of the invention are provided for the purpose of illustration only and not limitation—the invention being defined by the claims and equivalents thereof.

What is claimed is:

1. An apparatus for closing opened packaging comprising:

(a) a base having an upper surface and a lower surface;

(b) a strap attached to the base;

(c) first and second complementary handle sections attached to the base and extending upwardly from the upper surface of the base, wherein the first and second handle sections together form a grippable handle and define a space therebetween for receiving the strap therethrough; and (d) wherein the first handle section has a lower end attached to the upper surface of the base and an upper end sloped in a first orientation, and further wherein the second handle section has a lower end attached to the upper surface of the base and an upper end sloped in a second orientation complementary to the first orientation of the sloped upper end of the first handle section.

2. The apparatus according to claim 1, wherein the lower surface of the base is concave.

3. The apparatus according to claim 1, wherein the upper surface of the base is convex.

4. The apparatus according to claim 1, wherein the first and second handle sections are arcuate.

5. The apparatus according to claim 1, further comprising means for connecting the first and second handle sections, whereby the first and second handle sections are moveable from an open position wherein the first and second handle sections define the space for receiving a strap therethrough to a connected position wherein the first and second handle sections are connected to each other.

6. The apparatus according to claim 1, wherein the first handle section includes a protruding member, and the second handle section includes a recess shaped and sized to receive the protruding member whereby the first handle section can be frictionally engaged to the second handle section.

7. The apparatus according to claim 6, the first and second handle sections are moveable from an open position wherein the first and second handle sections define the space for receiving a strap therethrough to a connected position wherein the protruding member of the first handle section is positioned within the recess of the second handle section whereby the first and second handle sections are frictionally engaged.

8. The apparatus according to claim 1, wherein the upper end of the second handle section is positioned substantially above the upper end of the first handle section.

9. The apparatus according to claim 1, wherein the lower surface of the base is concave to facilitate positioning of the lower surface of the base on a package.

10. The apparatus according to claim 1, further comprising a matrix of support members formed in the base providing structural reinforcement to the base.

11. The apparatus according to claim 1, further comprising a layer of rubber attached to the lower surface of the base for positioning on a package opening, wherein the rubber layer minimizes movement of the base when positioned on a package.

12. The apparatus according to claim 1, wherein the strap has a first end attached to the base and a second end opposite to the first end, and further comprising a first section of fasteners positioned on a bottom surface of the strap proximate the second end, and a second section of fasteners positioned on a top surface of the strap, the first section of fasteners and the second section of fasteners adapted for complementary engagement.

13. The apparatus according to claim 12, wherein the first section of fasteners comprises hook fasteners, and the second section of fasteners comprises loop fasteners.

14. A method of securing closure of an opened package comprising the steps of:

(a) providing a closure device comprising:

(i) a base having an upper surface and a lower surface, (ii) a strap having a first end attached to the base and a second end opposite to the first end, and a first section of fasteners positioned on a bottom surface of the strap proximate the second end, and a second section of fasteners positioned on a top surface of the strap, the first section of fasteners and the second section of fasteners adapted for complementary engagement, and (iii) first and second complementary handle sections attached to the base and extending upwardly from the upper surface of the base, the first and second handle sections forming a grippable handle and defining a space therebetween for receiving the strap therethrough;

(b) positioning the base over an opening in the package;

(c) wrapping the strap around the package;

(d) pulling the strap through the space defined by the first and second handle sections; and (e) engaging the first section fasteners to the second section fasteners.

15. The method according to claim 14, further comprising the steps of:

(a) attaching the first handle section to the second handle section; and (b) gripping the first and second handle sections to carry the package.

* * * * *